US007726104B2

(12) United States Patent
Buchko et al.

(10) Patent No.: US 7,726,104 B2
(45) Date of Patent: Jun. 1, 2010

(54) VACUUM PACKAGING SYSTEM WITH END CUTTER

(75) Inventors: Raymond G. Buchko, Neenah, WI (US); Dwayne C. Long, New London, WI (US)

(73) Assignee: CP Packaging, Inc., Appleton, WI (US)

( * ) Notice: Subject to any disclaimer, the term of this patent is extended or adjusted under 35 U.S.C. 154(b) by 100 days.

(21) Appl. No.: 11/766,628

(22) Filed: Jun. 21, 2007

(65) Prior Publication Data

US 2008/0022637 A1 Jan. 31, 2008

Related U.S. Application Data

(60) Provisional application No. 60/805,392, filed on Jun. 21, 2006.

(51) Int. Cl.
*B65B 31/04* (2006.01)

(52) U.S. Cl. ..... 53/512; 53/86; 53/95; 53/405; 53/510; 53/513

(58) Field of Classification Search ..... 53/86, 53/95, 405, 434, 510, 512, 513, 120, 511, 53/509, 477, 432, 408, 435
See application file for complete search history.

(56) References Cited

U.S. PATENT DOCUMENTS

| | | | | | |
|---|---|---|---|---|---|
| 3,958,391 | A | * | 5/1976 | Kujubu | 53/434 |
| 4,182,095 | A | * | 1/1980 | Day | 53/86 |
| 4,457,122 | A | * | 7/1984 | Atkins et al. | 53/434 |
| 4,471,599 | A | * | 9/1984 | Mugnai | 53/434 |
| 4,578,928 | A | | 4/1986 | Andre et al. | |
| 4,583,347 | A | | 4/1986 | Nielsen | |
| 4,601,159 | A | * | 7/1986 | Mugnai | 53/511 |
| 4,754,596 | A | | 7/1988 | Yasumune et al. | |
| 4,817,365 | A | | 4/1989 | Yawberg et al. | |
| 4,843,796 | A | | 7/1989 | Furukawa | |
| 4,922,686 | A | | 5/1990 | Segota | |
| 5,009,060 | A | | 4/1991 | Furukawa | |
| 5,054,266 | A | | 10/1991 | Mello et al. | |
| 5,056,292 | A | | 10/1991 | Natterer | |
| 5,056,295 | A | * | 10/1991 | Williams | 53/450 |
| 5,131,213 | A | * | 7/1992 | Shanklin et al. | 53/477 |
| 5,239,808 | A | | 8/1993 | Wells et al. | |
| 5,454,214 | A | | 10/1995 | Lancaster | |
| 5,638,664 | A | | 6/1997 | Levsen et al. | |
| 5,822,956 | A | | 10/1998 | Liechti et al. | |
| 6,167,683 | B1 | | 1/2001 | Wong | |
| 2001/0011562 | A1 | | 8/2001 | Bailly | |
| 2002/0083683 | A1 | | 7/2002 | Suga | |
| 2003/0046907 | A1 | | 3/2003 | Costello | |
| 2004/0139701 | A1 | * | 7/2004 | Cady et al. | 53/434 |
| 2004/0172924 | A1 | * | 9/2004 | Suga | 53/510 |
| 2005/0022471 | A1 | | 2/2005 | Higer | |

(Continued)

*Primary Examiner*—Thanh K Truong
(74) *Attorney, Agent, or Firm*—Boyle Fredrickson, S.C

(57) ABSTRACT

The present invention relates to a vacuum packaging system having an automatic bag cutter. The vacuum packaging system includes a housing constructed to sealingly engage a platen. A vacuum system is constructed to remove the gas from a container, or bag, placed between the housing and the platen. A blade is operable to sever excess material of the bag whereupon the bag is evacuated by the vacuum system, and a seal bar seals the severed end area of the bag.

8 Claims, 8 Drawing Sheets

U.S. PATENT DOCUMENTS

2005/0178090 A1 * 8/2005 Koke et al. ..... 53/434
2005/0205455 A1 9/2005 Harrison
2005/0286815 A1 12/2005 ErkenBrack
2006/0016155 A1 1/2006 Oesterlein

* cited by examiner

VACUUM PACKAGING SYSTEM WITH END CUTTER

CROSS-REFERENCE TO RELATED APPLICATION

This application claims the benefit of U.S. Ser. No. 60/805,392, filed Jun. 21, 2006, the disclosure of which is incorporated herein by reference.

BACKGROUND OF THE INVENTION

The present invention relates generally to vacuum packaging systems and, more particularly, to a vacuum packager constructed to secure, sever, evacuate and seal an open edge of a container, such as a flexible vacuum packaging bag.

Foodstuffs and other products are commonly packaged in vacuum sealed bags and similar containers to prevent premature spoilage. During the vacuum packaging process, the excess fluid, typically air, within the container or bag is evacuated and the open end of the bag is then sealed. The sealing of the bag prevents contamination of the goods or materials contained within the bag. In order to ensure a hermetic seal of the bag, the bag must be securely and relatively uniformly engaged by the sealing system. Furthermore, the vacuum packager must be constructed to allow uninterrupted removal of the sealed bag from the vacuum packager in order to ensure that the sealed bag is not perforated after being sealed. The process of sealing the bag often results in an unsealed end area which must then be severed in order to produce an aesthetic product. Accordingly, there is a need for an improved vacuum sealing process that efficiently and effectively trims the unsealed end area of the bag. There is also a need for an improved vacuum packaging system that enables evacuation without requiring retraction of the knife that severs the end area of the bag, in order to reduce cycle time.

BRIEF DESCRIPTION OF THE INVENTION

The present invention relates to a vacuum packager that includes an automatic bag cutter and bag sealer in which a bag or other container is cut prior to evacuation of the bag and sealing the contents within the bag. The vacuum packager includes a housing constructed to sealingly engage a platen. Prior to evacuation, the bag is cut using a suitable blade. In this regard, the excess material that would normally be cut after evacuation in prior art systems is cut prior to evacuation. After the bag is then cut, the vacuum system removes gas from the bag placed between the housing and the platen. The bag is sealed after it has been evacuated. In one embodiment, the blade has a series of holes formed through the blade body transverse to its cutting edge. These holes form flow passages that allow evacuation through the blade following cutting of the bag while the housing remains engaged with the platen. Alternately, the blade may be retracted while the housing remains engaged with the platen to permit evacuation from the bag.

Therefore, in accordance with one aspect of the invention, a vacuum packager includes a housing, a vacuum system, a bag bar, a cutter, and a sealer. The housing engages a platen and cooperates with the platen to define a cavity. The vacuum system evacuates gas from the cavity. The bag bar is operable to secure the bag in position, and the cutter is positioned proximate the bag bar for severing a terminal end area of the bag. The sealer is operable to seal the bag on a side of the bag bar opposite the cutter.

Another aspect of the invention involves a cavity evacuation and closure system having a vacuum system constructed to remove a gas from a container. The system includes a packager having a first securing bar constructed to secure a first portion of the container. A second securing bar is constructed to secure a second portion of the container proximate the first portion. A severing tool is disposed between the first and second securing bars, and a sealer is disposed on a product side of the first and second securing bars.

Yet another aspect of the invention involves a method of packaging a container, such as a bag. The method includes the steps of placing an article to be packaged into the interior of a bag having a closed and an open end, severing the bag at the open end, evacuating fluid from the bag, and then sealing the evacuated bag at the open end so as to enclose the article within the bag.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
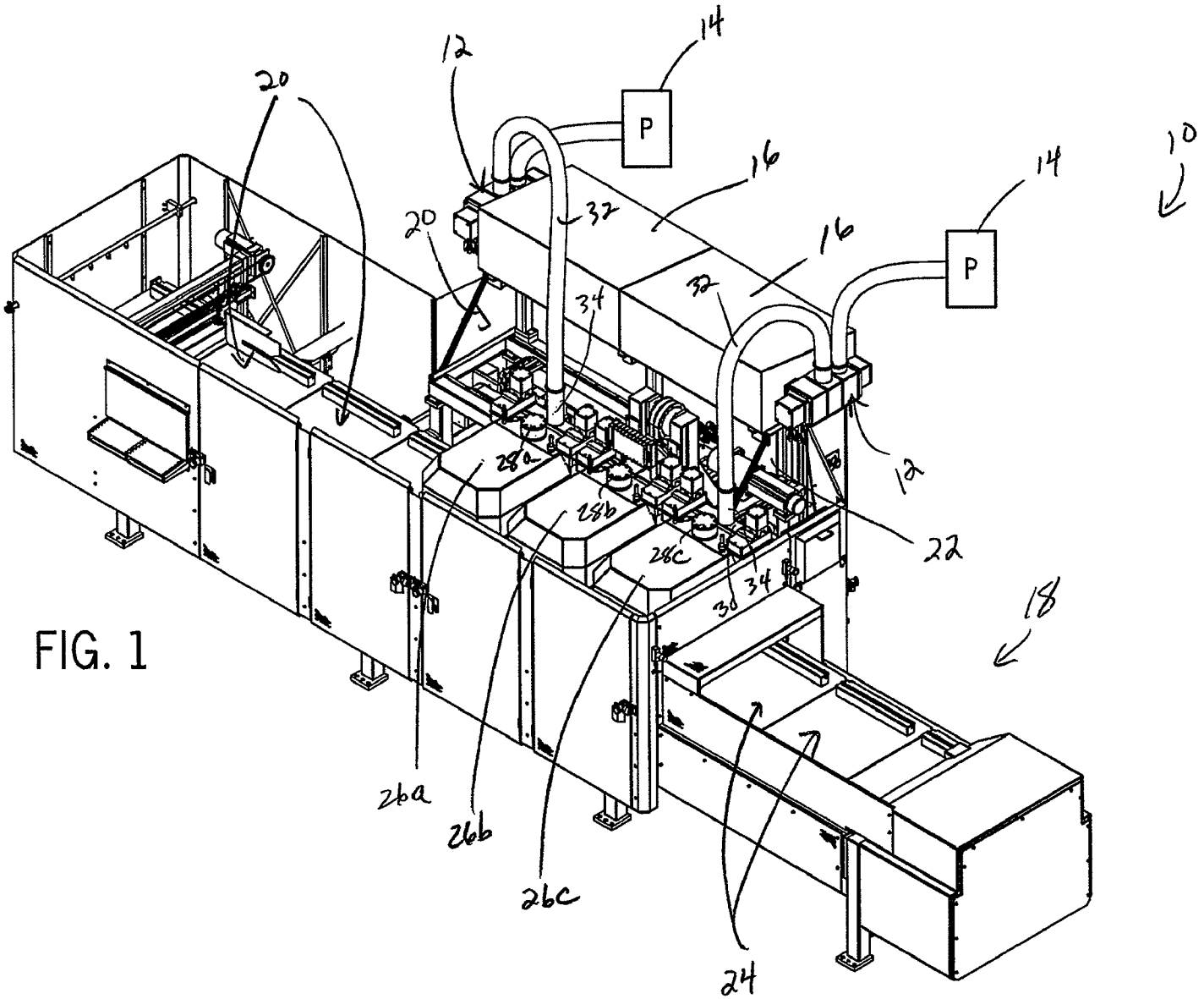
FIG. 1 is an isometric view of a linear motion vacuum packaging system, which is a representative application for the system and method for evacuating and sealing a volume or chamber in accordance with the present invention.

FIG. 1 illustrates a representative embodiment of a vacuum packaging system 10 incorporating a pair of control valve systems 12 to selectively connect a pair of vacuum pumps 14, a pair of evacuation vessels 16, and a volume to be evacuated to one another. In the illustrated example, the vacuum packaging system 10 is a linear motion vacuum packaging system and thus includes a conveyor 18 that advances items (not shown) to be vacuum packaged along the length of the vacuum packaging system 10 in a linear primary path of travel. The vacuum packing system 10 further includes an evacuation arrangement 20, which is mounted to a vertical support 22 that also holds the pair of evacuation vessels 16, with the control valve systems 12 mounted thereto, suspended above the evacuation arrangement 20. The control valve system 12 cooperates with conveyor 18 to evacuate and seal the items to be vacuum packaged as those items are conveyed by conveyer 18.

Conveyor 18 includes a series of platens 24, each of which is adapted to receive and support an article and receptacle (not shown). Generally, any article suitable for vacuum packaging, such as a perishable food products, may be vacuum packaged by the vacuum packaging system 10 and the receptacle may be any satisfactory open-ended receptacle, such as a sealable bag, sized to receive the article and suitable for vacuum packaging, as is known in the art. Conveyor 18 may be configured to advance incrementally at spaced intervals in an indexing fashion, or may be configured to provide continuous advancement of items supported by conveyor 18, either at a continuous rate of speed or at variable rates of speed. The platens 24 are advanced by conveyor 18 and cooperate with evacuation arrangement 20 to evacuate and seal the article within the receptacle.

The evacuation arrangement 20 includes a series of identical vacuum chambers or heads 26*a-c*, each of which is associated with a cylinder 28*a-c* containing valves that control the supply of vacuum to the interior of the associated vacuum chambers 26*a-c*. More particularly, each vacuum chamber 26*a-c* is provided with negative pressure by a header 30 that is fluidly connected to pumps 14 by conduits 32, which may be hose, tubing, pipe, or the like. The header 30 includes fittings 34 that mate with conduits 32 to deliver negative pressure provided to the conduit 32 by pumps 14. When valves 28*a-c* are open, negative pressure is delivered from the header 30 to the vacuum chambers 26*a-c*. Header 30 acts as a combination vacuum manifold and support for vacuum heads 26*a-c*, and replaces the need for each vacuum chamber 26*a-c* to be directly connected to pumps 14.

The vacuum packaging system 10 and evacuation arrangement 20 include components not specifically described herein, but which are known in the art, such as a user interface module, various drive motors, drive belts, belt tensioners, guide rollers, and pulleys, as described in PCT Application PCT/US2005/015833 and U.S. Ser. No. 11/747,519, the disclosures of which are incorporated herein by reference.

Figure 2:
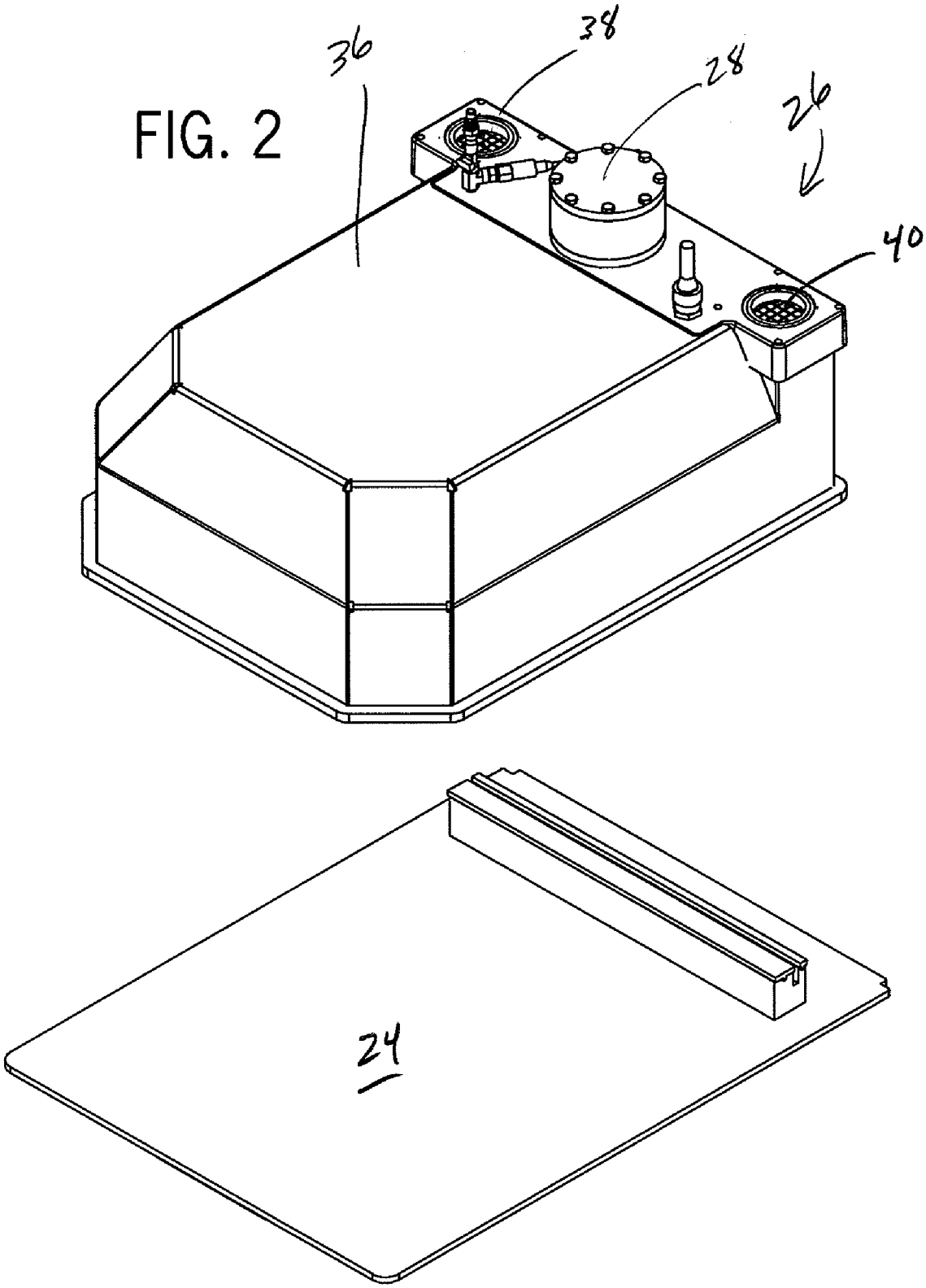
FIG. 2 is an isometric top view of a representative vacuum head shown spaced from a platen of the vacuum packaging system shown in FIG. 1.

FIG. 2 shows a representative vacuum head 26 according to the present invention spaced from a plate or platen 24. Vacuum head 26 includes a housing 36 that is constructed to sealingly engage the platen 24 with a container (not shown) to be sealed disposed between the housing 36 and the platen 24. A plurality of vacuum passages 38, 40 extend through housing 36 and are constructed to be connected to a vacuum, such as described with respect to FIG. 1. Operation of the vacuum system evacuates the gas from the cavity enclosed between housing 36 and platen 24. Control valve 28 selectively supplies vacuum from to the interior of housing 36 and to expose the interior of housing 36 to ambient air pressure.

Figure 3:
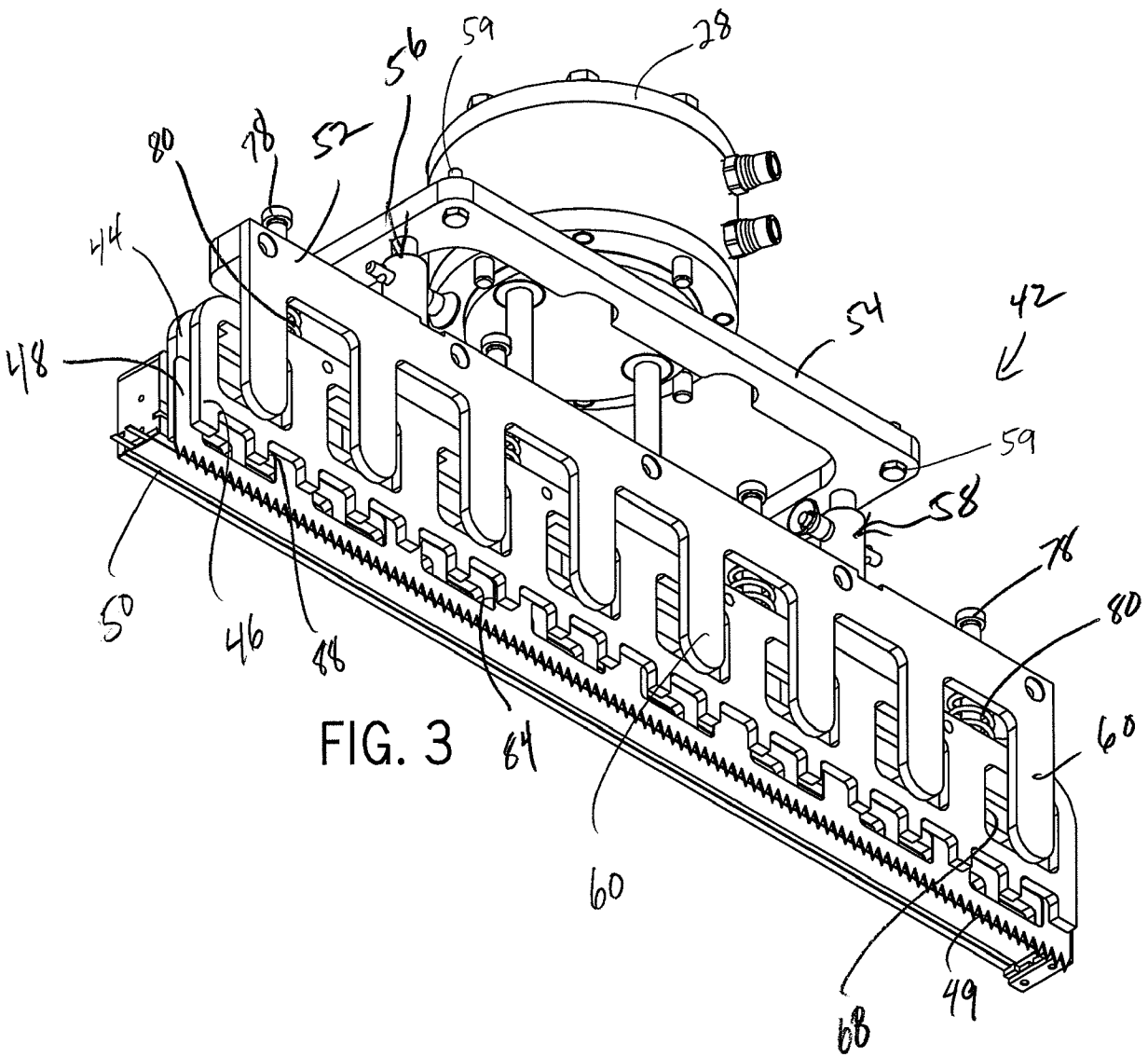
FIG. 3 is an isometric view of a cutter and sealer assembly of the vacuum packaging system of FIG. 1, and which is contained in the interior of the vacuum head of FIG. 2.

Referring now to FIG. 3, the vacuum head 26 further includes a clamping and closure system 42 disposed between housing 36 and platen 24. The closure system 42 includes a pair of retaining bars 44, 46 spaced from one another to allow a blade 48, which may have a serrated edge 49, to pass therebetween. Retaining bar 44 is located adjacent a sealer 50 that, as will be described, functions to hermetically seal a container, such as a bag, following cutting and evacuation of the container. The retaining bars 44, 46, blade 48, and sealer 50 are carried by a carriage 52 that is coupled to a stabilizer frame or bracket 54 by a pair of lockpin connections 56, 58. Stabilizer bracket 54 is secured to the top wall of housing 36 via a series of connectors, such as shown at 59. Carriage 52, and the retaining bars 44, 46, and blade 48, move upwardly and downwardly relative to platen 24 by upward and downward movement of housing 36. Movement of the sealer 50 is controlled by valves (not shown) contained within cylinder 28.

Figure 4:
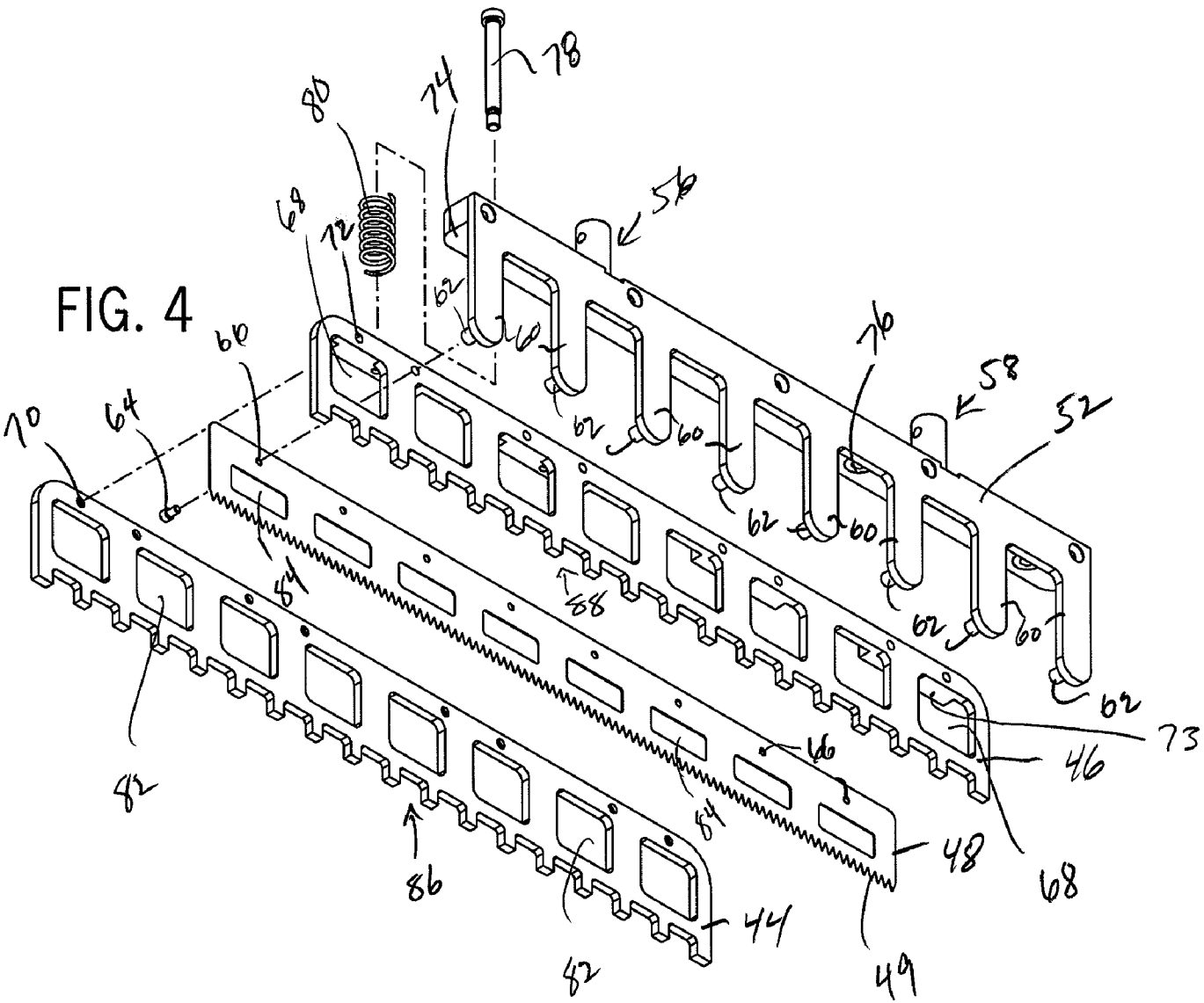
FIG. 4 is an exploded view of a portion of the cutter and sealer assembly shown in FIG. 3.
Figure 5:
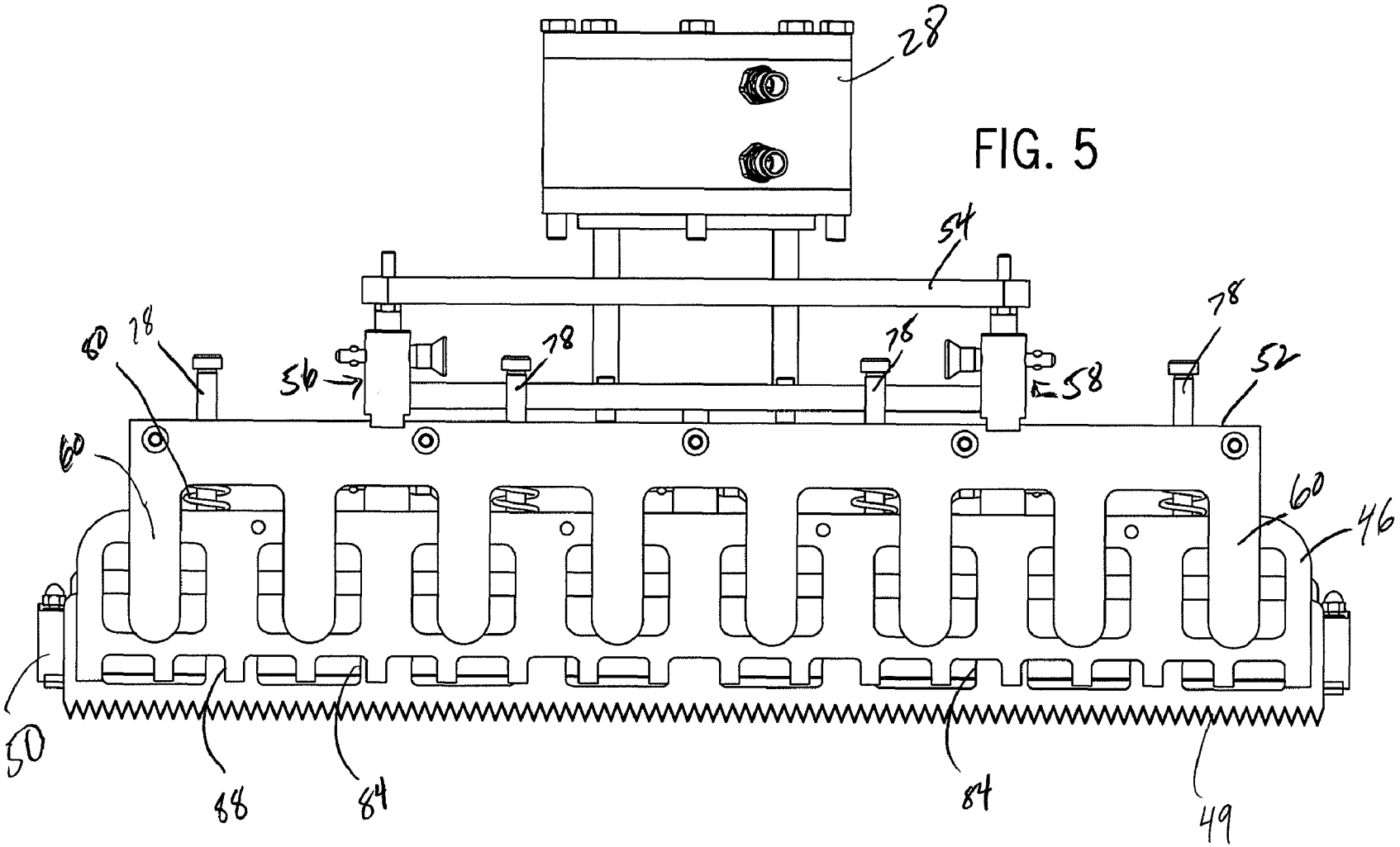
FIG. 5 is an elevation view of the cutter and sealer assembly shown in FIG. 3.

With additional reference to FIGS. 4-5, carriage 52 includes a series of equidistantly spaced legs 60, each of which has a boss 62 extending laterally therefrom. Each boss 62 is adapted to receive a mounting pin 64 that is passed through a bore 66 defined along a top portion of blade 48. The legs 60 of carriage 52 are constructed such that bosses 62 extend through openings 68 formed in the retaining bar 46. Retaining bar 44 is secured to retaining bar 46 using a bolt or other suitable fastener (not shown) that is inserted through openings 70, 72 formed in retaining bars 44, 46, respectively. Retaining bar 46 include an upper ledge 73, which engages the upper area of retaining bar 44 and which functions to define a space between retaining bars 44, 46 within which blade 48 is contained. Ledge 73 may be formed with the recesses to accommodate airflow into the space between retaining bars 44, 46. Carriage 52 also includes a mounting ledge 74 having a series of mounting holes 76 through which a pin 78 may be inserted and coupled to blade 48. More particularly, the pin 78 is passed through a spring 80 and then coupled to blade 48. As will be described, the spring 80 allows the carriage 52 to translate along the pin 78 while maintaining the position of the blade 48 unchanged. The spring 80 bears between the upwardly facing surface of ledge 73 and of the downwardly facing surface of ledge 74, and functions to normally bias blade 48 toward an extended position relative to carriage 52.

Retaining bar 44 has openings 82 that align with openings 68 of retaining bar 46. Additionally, blade 48 has openings 84 formed in the blade body. As will be described below, the openings 68, 82, and 84 define flow passages through which fluid, e.g., gas may pass during evacuation of a container. To provide additional evacuation paths, the retaining bars 44, 46 each have a notched edge 86, 88, respectively. The notched edges 86, 88 effectively form openings between the retaining bars 44, 46 and the platen 24 when the blade 48 is lowered into a cutting position, which may result in the openings 84 of the blade no longer aligning with openings 68, 82 of the retaining bars 46, 44.

Figures 6, 7, 8:
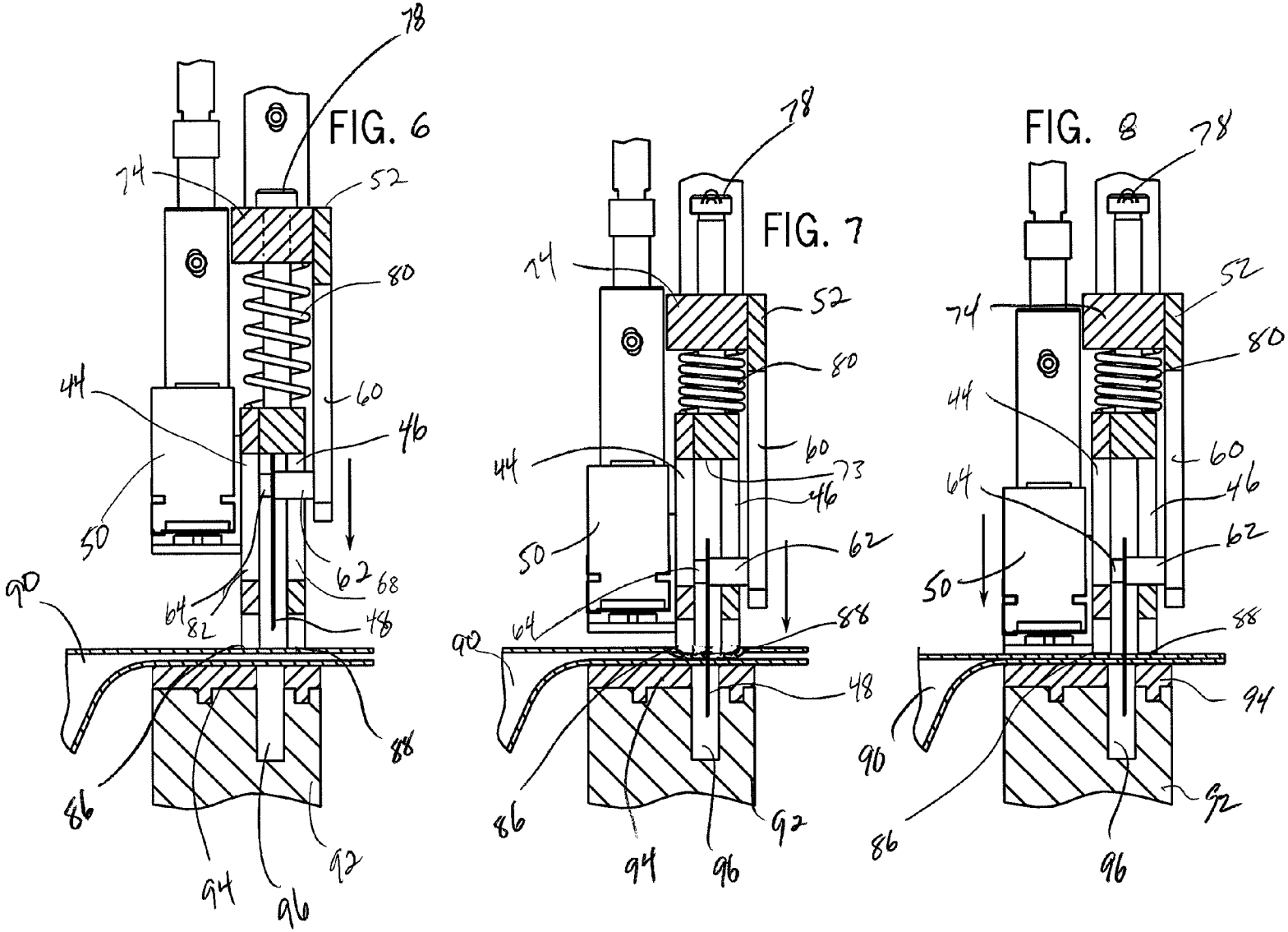
FIGS. 6-8 are sequential side views of the operation of the cutter and sealer assembly shown in FIG. 3.

FIGS. 6-8 show a sequence of steps carried out by the vacuum packaging system to evacuate and seal a container. Specifically, FIG. 6 shows the closure system with the blade 48 in an open or retracted position. In this position, the blade 48 and sealer 50 are elevated relative to a container 90, e.g., a bag that contains an article to be vacuum packaged, disposed on an anvil or cutting bar 92 supported by platen 24 (not shown). The anvil 92 includes a cutting surface 94 having an upwardly facing groove 96. The groove 96 is recessed into the cutting surface 94 and is sized to receive blade 48 during severing of container 90. The retaining bars 44, 46, however, are aligned with areas on the anvil 92 on either side of the groove 96. The position of the closure system shown in FIG. 6 is attained when housing 36 is located above the platen 24 and is being advanced toward platen 24, but prior to engagement of the lower edge of housing 36 with the upwardly facing surface of platen 24. As housing 36 is being advanced toward the upwardly facing surface of platen 24, the edges 86, 88 of retaining bars 44, 46, respectively, come into contact with the areas on the anvil 92 on either side of the groove 96, to securely clamp and hold container 90 against the cutting surface 94. The notches in the edges 86, 88 of retaining bars 44, 46, respectively, provide recesses located above the upper wall of the container 90.

As shown in FIG. 7, once the container 90 is secured against the cutting surface 94 by retaining members 44, 46, movement of housing 36 toward platen 24 is continued so as to advance the lower edge of housing 36 toward platen 24. When housing 36 comes into contact with the upwardly facing surface of platen 24, housing 36 and platen 24 function to define a volume that is destined to be evacuated upon operation of vacuum packaging system 10. During such movement of housing 36 into engagement with platen 24, bracket 54 is moved downwardly so as to move carriage 52 downwardly, which causes blade 48 to move past the edges 86, 88 of retaining bars 44, 46, respectively, and through the walls of container 90 into groove 96. This functions to sever the end of container 90, and the severed end of container 90 is held in position by engagement of lower edge 88 of retaining bar 46 with cutting surface 94. During such downward movement of carriage 52, spring 80 is compressed by downward movement of carriage 52 and ledge 74 while ledge 73 of retaining bar 44 is maintained and stationary. In this regard, the carriage 52 and blade 48 are effectively allowed to ride in downwardly on the pins 78 while retaining bars 44, 46 remaining seated on anvil 92. As the spring 80 is compressed, the blade 48 passes through the container 90 into groove 96 thereby severing the container 90 along the cutting axis.

Figure 9:
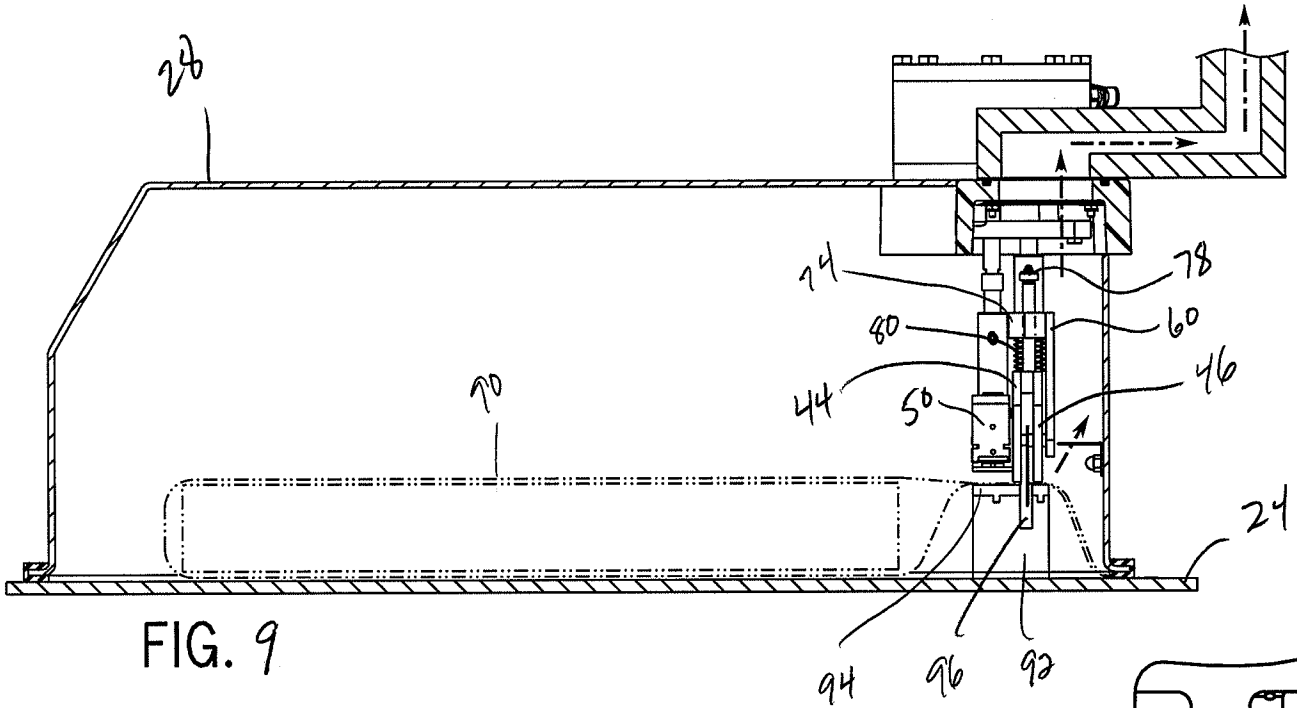
FIGS. 9-10 are section views of a vacuum head and the cutter and sealer assembly of the vacuum packaging system of FIG. 1 shown during evacuation of a volume according to one embodiment of the present invention.
Figure 10:
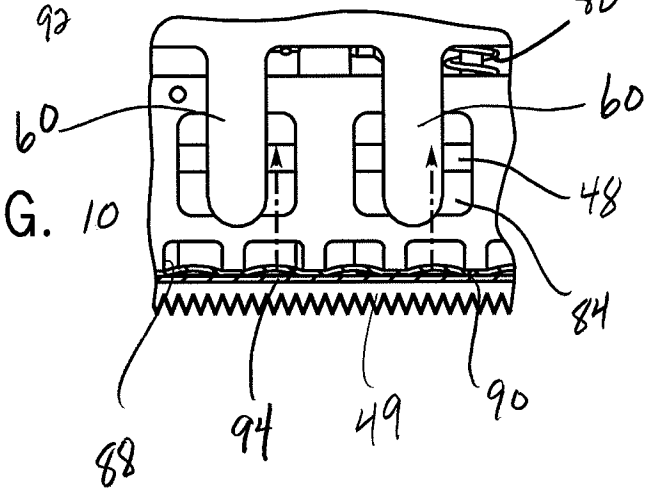

After the end area of the container 90 has been severed as described above, the container 90 is evacuated by evacuation of the volume defined by housing 36 and platen 24. The sealer 50 is then lowered against the container 90 by operation of cylinder 28, to seal the end of the container 90 and are thereby maintain in the negative air pressure within the interior of the container 90. Thus, the container 90 is severed before it is evacuated. In the illustrated embodiment, the blade 48 remains seated in groove 96 during the evacuation process. The openings 84 formed in the blade 48 allow gas to pass through the blade 48 during the evacuation process. As shown in FIGS. 9-10, gas can be evacuated from the cavity of the vacuum housing 36, and thus the container 90, through the blade 48 by virtue of the flow paths formed by the openings 84 in the body of blade 48 and through the channels or recesses defined by the lower edge 86 of retaining bar 44. FIG. 10 illustrates that, during the evacuation process, the upper wall of the container 90 deforms into the recesses defined by the channels or recesses in the lower edge 86 of retaining bar 44, to enable gas to escape from the interior of the container 90. After the evacuation process is complete, the sealer 50 is lowered into place by operation of cylinder 28, as described above and shown in FIG. 8, to seal the severed end of the now-evacuated container 90.

Alternately, it is contemplated that the blade may be independently lowered into and raised out of position by an actuator arm which would permit a solid blade to be used rather than the perforated blade described above. In this alternate embodiment, the blade would be retracted from the groove prior to the evacuation process. The openings formed in the retaining bars would provide flow paths for evacuating gas from the vacuum head.

Figure 12:
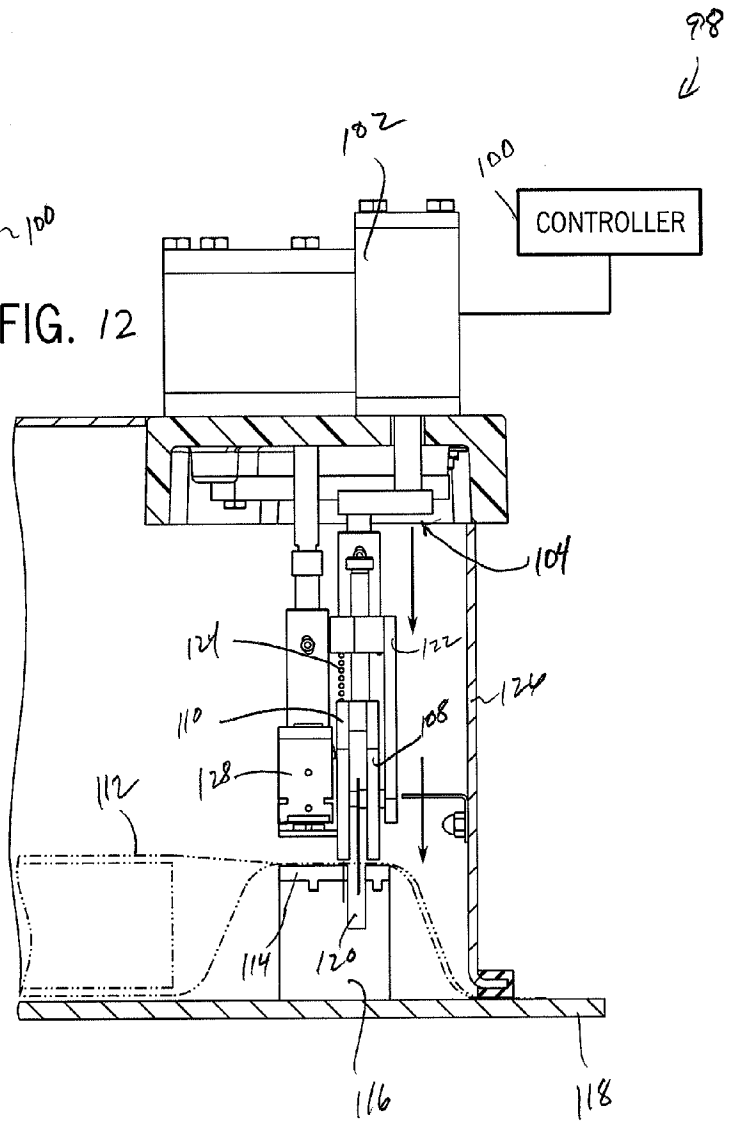
FIGS. 11-12 are sequential side views of the operation of an alternate cutter and sealer system according to a further embodiment of the present invention.
Figure 11:
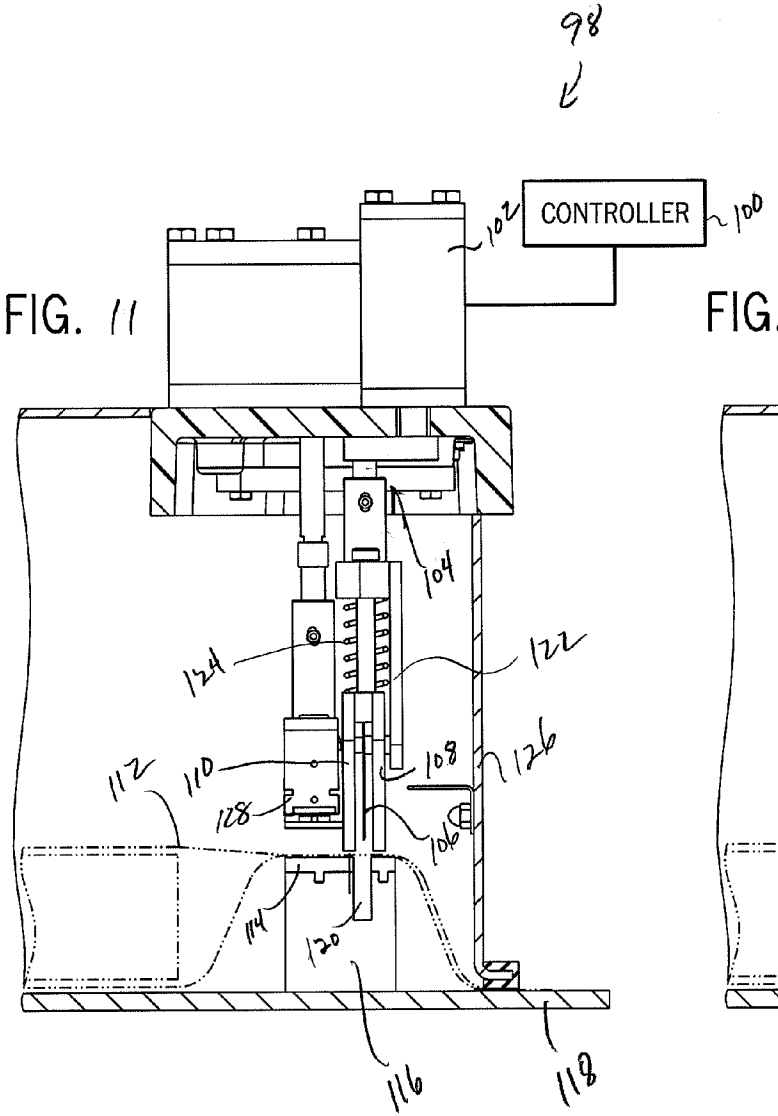

For instance, and referring now to FIGS. 11-12, cutter and sealer system 98 includes a controller 100 coupled to a cylinder 102 to control the movement of an actuator 104 that is coupled to blade 106. Similar to the embodiment previously described, the blade 106 is disposed between a pair of retaining bars 108, 110 that secure a container 112 to the cutting surface 114 of an anvil 116 mounted to platen 118. The anvil 116 has a groove 120 recessed through the cutting surface 114 and is adapted to receive the blade 106 during the down-stroke of the blade 106 as it severs container 112. The pair of retaining members 108, 110 and blade 106 are coupled to a carriage 122 such that during the down-stroke of the blade 106, via downward movement of actuator 104, the carriage 122 compresses spring 124, as shown in FIG. 12. In this regard, the seating of the retaining bars 108, 110 on the cutting surface 114 of the anvil 116 is held intact as the blade 106 is lowered and raised.

Blade 106 may be perforated such that flow paths are formed through its body, such as described above, which would permit evacuation of the vacuum head 126 and the container 112 even when the blade 106 is seated in the groove 120; or, alternately, the actuator 104 may be controlled by the controller 100 to retract the blade 106 prior to the evacuation process. In the case of the latter, the coupling of the blade 106, retaining bars 108, 110, and the carriage 122 allows the blade 106 to be retracted without retracting the retaining bars 108, 110. The retaining bars 108, 110 have a perforated body, such as described above, which forms multiple flow paths so that gas may be evacuated from the vacuum head 126 even when the retaining bars 108, 110 are seated on the anvil 116. This construction is advantageous because it maintains the engagement of the container 112 on the cutting surface 114 during the evacuation process and subsequent sealing process carried out by sealer 128. Thus, similar to the embodiment described above, cutter and sealer system 98 is designed such that a container is severed, then evacuated, and then sealed.

Accordingly, the present invention includes a vacuum packaging system having an automatic bag sealing and end severing closure system. The vacuum packaging system includes a housing constructed to sealingly engage a platen. A vacuum head is constructed to remove the gas from a container, or bag, placed between the housing and the platen. The vacuum head severs the excess material of the bag, whereupon the bag is evacuated and then sealed.

Therefore, one embodiment of the invention includes a vacuum head having a housing, a vacuum system, bag bar, a cutter, and a sealer. The housing is for engaging a platen and enclosing a cavity therebetween. The vacuum system is for evacuating a gas from the cavity. The bag bar is bar for securing a position of a bag and the cutter is positioned proximate the bag bar for severing a terminal end of the bag. The sealer is for sealing the bag on a side of the bag bar opposite the cutter.

Another embodiment of the invention includes a cavity evacuation and closure system having a vacuum system constructed to remove a gas from a container. The system includes a head having a first securing bar constructed to secure a first portion of the container. A second securing bar is constructed to secure a second portion of the container proximate the first portion. A severing tool is disposed between the first and second securing bars and a sealer is disposed on a product side of at least one the securing bar and another securing bar.

A further embodiment of the invention includes a method of packaging a container. The method includes placing a widget in a bag having a closed end and an open end, severing the bag at the open end, evacuating fluid from the bag, and sealing the evacuated bag at the open end.

The present invention has been described in terms of the preferred embodiment, and it is recognized that equivalents, alternatives, and modifications, aside from those expressly stated, are possible and within the scope of the impending claims.

What we claim is:

1. A vacuum packaging system comprising:

a housing for engaging a platen and enclosing a cavity therebetween;

a vacuum system for evacuating fluid from the cavity;

a bag retainer for securing a position of a bag within the cavity, wherein the bag retainer defines an engagement surface and is movable between an engaged position and a disengaged position, wherein, when the bag retainer is in the engaged position, the engagement surface is in engagement with a wall of the bag so as to secure the position of the bag within the cavity, and wherein the bag retainer includes a plurality of recesses formed adjacent the engagement surface, and wherein, when the bag retainer is in the engaged position and the vacuum system is operated to evacuate fluid from the cavity, the wall of the bag is deformed into the recesses so as to enable evacuation of fluid from within the bag;

a cutter positioned proximate the bag retainer for severing a terminal end of the bag, the cutter having a blade movable between an extended position and a retracted position, and wherein the blade includes an edge configured for engaging and severing the terminal end of the bag when the blade is moved to the extended position prior to operation of the vacuum system, and wherein the blade further comprises one or more openings spaced from the edge by a solid portion of the blade such that the openings in the blade are in fluid communication with the recesses in the engagement surface of the bag retainer to provide a flow path that enables the fluid to pass from the bag and through the one or more openings in the blade and into the cavity; and a sealer for sealing the bag after evacuation of the bag by operation of the vacuum system.

2. The vacuum packaging system of claim 1 wherein the bag retainer comprises a pair of retainer members that engage the bag on opposite sides of the cutter.

3. The vacuum packaging system of claim 1 wherein the blade remains in the extended position during operation on the vacuum system to evacuate fluid from the cavity and thereby from within the bag.

4. The vacuum packaging system of claim 1 further comprising an engagement member for engaging the bag on a side of the bag opposite the bag retainer.

5. The vacuum packaging system of claim 4 wherein the engagement member includes a groove for receiving the cutter when the cutter is moved to the extended position.

6. The vacuum packaging system of claim 5 wherein a profile of the cutter substantially matches a profile of the groove.

7. The vacuum packaging system of claim 1 further comprising an actuator coupled to the cutter and adapted to move the cutter between the retracted position and the extended position independently of the bag retainer and the sealer.

8. The vacuum packaging system of claim 1 wherein the sealer is operative to seal the bag after the terminal end of the bag has been severed and the bag has been evacuated.

* * * * *